United States Patent [19]

Ling et al.

[11] Patent Number: 4,989,523

[45] Date of Patent: Feb. 5, 1991

[54] METHOD AND APPARATUS FOR EXTRACTING HEAT FROM A COMBUSTIBLE MATERIAL

[75] Inventors: Sung C. Ling; Hsien P. Pao, both of Silver Spring, Md.

[73] Assignee: General Technology, Inc., Silver Spring, Md.

[21] Appl. No.: 494,506

[22] Filed: Mar. 16, 1990

[51] Int. Cl.[5] ..... F23B 7/00

[52] U.S. Cl. ..... 110/341; 44/532; 44/530; 110/218; 110/223; 110/234

[58] Field of Search ..... 44/14, 532; 110/218, 110/223, 346, 269, 341, 234

[56] References Cited

U.S. PATENT DOCUMENTS

| | | | |
|---|---|---|---|
| 73,922 | 1/1868 | Philbrick | 44/14 |
| 1,285,087 | 11/1918 | Fay | 44/14 |
| 1,929,424 | 10/1933 | Heaton | 110/269 |

*Primary Examiner*—Edward G. Favors

*Attorney, Agent, or Firm*—Burns, Doane, Swecker & Mathis

[57] ABSTRACT

A method and apparatus for extracting heat from a combustible material are disclosed which include the formation of a solid material strip of the combustible material, the formation of a series of spaced holes in the material strip, and the combustion of the material strip. The method and apparatus are particularly useful when a mixture of coal, clay, and lime is used as the combustible material, and the products of the combustion then include a structurally intact, solid residual strip composed substantially only of dehydrated clay and calcium sulfate, and a fluegas substantially free of carbon monoxide, nitrogen oxides, sulfur oxides, and micro fly-ash. Because of the stable and uniform combustion characteristic, it is also suitable for the co-combustion and reduction of most toxic and solid wastes into safe, recyclable residues.

35 Claims, 2 Drawing Sheets

METHOD AND APPARATUS FOR EXTRACTING HEAT FROM A COMBUSTIBLE MATERIAL

BACKGROUND OF THE INVENTION

1. Field of the Invention

The present invention relates generally to methods and apparatuses for extracting heat from combustible materials, and, more particularly, to a method and apparatus for combusting a solid material strip at a controlled temperature.

2. Description of the Prior Art

Historically, solid fuel was burnt mainly by the flat-bed combustion process. In the past two decades, solid fuel was replaced by liquid fuel, because liquid was less labor intensive and was cleaner in operation. The liquid fuel was burnt by spraying the liquid fuel through a high-speed nozzle to atomize the fuel. In recent years, as liquid fuel became more costly, many power plants were modified for both liquid and powdered solid fuel combustion using the spraying technique originally designed for the liquid fuel. For home heating, liquid fuel is still in wide use, mainly due to the handling and pollution problems of solid fuel.

The fundamental problem with both liquid and powdered solid fuel combustion is that both types of combustion are unstable runaway forms of combustion which generally take place within 10 milliseconds, since it is nearly impossible to control the reaction rates inherent in these types of combustions. The resultant high temperatures of combustion promote excessive production of carbon monoxide, nitrogen oxides, and sulfur oxides, and the production of corrosive and coating micro flyash. These byproducts of combustion are the cause of many environmental and operational problems, i.e. the pollution of the atmosphere and the coating of heat exchangers resulting in reduced heat exchange efficiency, whose avoidance greatly increases the cost of combusting liquid and powdered solid fuels.

Also, the processes used in the prior art combustion methods often result in combustion temperatures of over 2000° C. At such a high temperature the combustion product is mainly CO instead of $CO_2$. Consequently, a large power plant requires a mammoth combustion chamber to provide sufficient resident time for the CO gas to complete a secondary combustion into $CO_2$ at a lower temperature of about 1000° C., thus increasing the cost of operating the power plant. It is clear that a form of combustion is needed which avoids these problems.

OBJECTS AND SUMMARY OF THE INVENTION

It is therefore an object of the present invention to overcome the disadvantages of the prior art methods by providing a method and apparatus of extracting heat from a combustible material which includes combusting a solid material strip having regularly shaped holes of a predetermined size therein.

Another object of the present invention is to provide a heat extraction method and apparatus which includes combusting a solid material strip at a desired temperature such that a fluegas produced by the combustion is substantially free of carbon monoxide, nitrogen oxides, sulfur oxides, and micro fly-ash.

Another object of the present invention is to provide a heat extraction method and apparatus in which one product of a combustion is a structurally intact, solid residual strip which may be easily removed from a combustion oven after combustion.

Another object of the present invention to provide a heat extraction method and apparatus which is relatively inexpensive to operate and maintain.

It is yet another object of the present invention to mix chemical compounds with the solid fuels for the purpose of complete and safe dissociation of toxic compounds either within the solid fuels or the additives into non-toxic solid residuals or flue gas. The stable and uniform combustion characteristics of the present invention is also ideal for the safe disposal of most garbage and toxic wastes.

The method of the present invention of extracting heat from a combustible material includes the steps of forming a solid material strip of the combustible material, forming a plurality of spaced holes in the material strip, and combusting the material strip in a combustion oven.

The method of the present invention may also include the steps of forming a solid material strip of the combustible material and providing a plurality of spaced holes punched into the material strip, and preheating the material strip in the absence of ambient air. The material strip is combusted in a combustion oven by two independent controls. The desired temperature of combustion is regulated by forcing air or oxygen into the spaced holes at a controlled rate, and a fluid is circulated at a controlled rate to carry heat from the combustion of the material strip to a heat exchanger at a desired rate. During the combustion, a structurally intact, solid residual strip is produced, and the residual strip is removed from the combustion oven.

The apparatus of the present invention for extracting heat from a combustible material includes a means for forming a solid material strip of the combustible material, a means for forming a plurality of spaced holes of predetermined diameters and spacings required for different rates of combustion in the material strip, and a means for combusting the material strip. The material strip combusting means includes a combustion oven.

The apparatus of the present invention may include an extrusion screw for extruding a solid material strip of the combustible material and a conveyor extending away from the extrusion screw for carrying the material strip. Located along the conveyor are a hole punch for punching a plurality of spaced holes into the material strip, and a preheating oven for preheating the material strip. A combustion oven located along the conveyor for combusting the material strip includes an inlet for the material strip, an outlet for a structurally intact solid residual strip, means for intaking air into the combustion oven, and means for removing a hot fluegas from the combustion oven.

BRIEF DESCRIPTION OF THE DRAWINGS

The preferred embodiment of the invention is described in the detailed description which should be considered in connection with the figures in the accompanying drawings, in which.

DETAILED DESCRIPTION OF THE INVENTION

Figure 1:
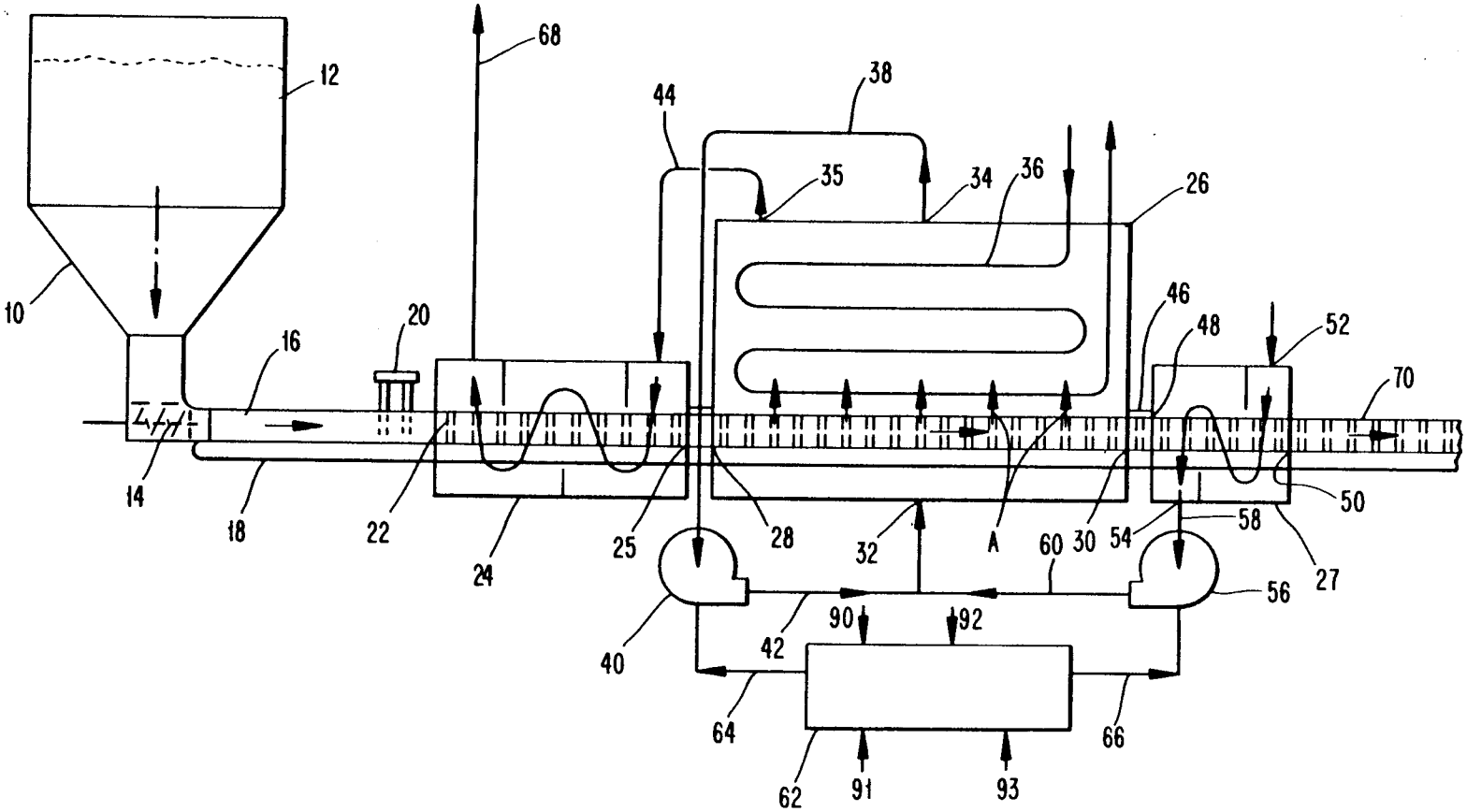
FIG. 1 is a schematic view of the apparatus of the present invention.

With reference to FIG. 1, the heat extracting apparatus of the present invention includes a hopper 10, an extrusion screw 14 located at the lower end of the hopper 10, and a conveyor 18 extending away from the extrusion screw 14 which runs the length of the apparatus. Located along the length of the conveyor are a hole punch 20, a preheating oven 24, a combustion oven 26, and an air-intake preheating chamber 27. The combustion oven 26 is connected to the preheating oven 24 by a first conduit 25, and includes a material strip inlet 28, a material strip outlet 30, an inlet 32 for air/oxygen and a heat exchanging fluid/fluegas, and first and second outlets 34,35 for a fluegas produced in the combustion oven 26. A heat exchanger 36 is also located within the combustion oven 26.

Piping 38 connects the first fluegas outlet 34 with a first blower 40 which in turn is connected by piping 42 to the air and heat exchanging fluid inlet 32. Piping 44 connects the second fluegas outlet 35 with the preheating oven 24.

The preheating chamber 27 is connected to the combustion oven 26 by conduit 46, and includes a preheating chamber residual strip inlet 48, a preheating chamber residual strip outlet 50, an air/oxygen inlet 52, and an air outlet 54. Air outlet 54 is connected to a second blower 56 by piping 58, and the second blower 56 is in turn connected to the air and heat exchanging fluid inlet 32 by piping 60. Both of the first and second blowers 40,56 are controlled by a computer 62, as is indicated generally at 64 and 66.

in operation, basic data input to the computer 62 are the system heat output 90 at the heat exchanger 36 and the combustion temperature 92 of the gas at A. The computer 62 compares these parameters with the system heat output rate command 91 and combustion temperature command 93 to operate the respective blowers 40 and 56 for an automatic regulation of the combustion system.

In operation, the hopper 10 holds a supply of a combustible material 12, generally in a granular or pulverized form. In the preferred embodiment, the combustible material 12 includes a moldable mixture of coal, clay, water and lime. As the extrusion screw 14 is turned, it extrudes a solid material strip 16 of the combustible material 12, and the preferred form of the material strip 16 is that of a continuous strip of uniform rectangular cross section. However, a material strip which is of a short finite length, or which has a non-rectangular cross section, may be used to achieve at least some of the advantages of the present invention.

The extrusion screw 14 extrudes the material strip 16 onto the conveyor 18, and the conveyor 18 carries the material strip 16 along the length of the apparatus. As the material strip 16 is carried along the conveyor 18, the hole punch 20 operates to punch a plurality of spaced holes 22 into the material strip 16. As will be described below, the diameter and spacing of the holes 22 is critical for achieving the desired combustion of the material strip 16. the feed rate for the material strip 16 will be controlled by the computer 62 depending on the power demand 91 and other secondary factors relating to the composition of fuels.

The material strip 16 then enters the preheating oven 24 wherein hot fluegas supplied by the piping 44 from the combustion oven 26 is circulated over the material strip 16. The preheating of the material strip 16 occurs in the absence of ambient air/oxygen, and so the temperature of the material strip 16 is raised to about 800° C. in the preheating oven 24 without combustion of the material strip 16. While the material strip 16 is being preheated, the volatile components of the coal in the material strip 16 are extracted with the circulating fluegas and are removed from the preheating oven 24 as by piping 68 so that the volatile components may be processed to obtain side products.

The preheated material strip 16 is next carried into the combustion oven 26 by the conveyor 18 through the first conduit 25 and the material strip inlet 28. As will be discussed in more detail below with reference to FIG. 2, air supplied by the air and heat exchanging fluid inlet 32 below the conveyor 18 flows into the spaced holes 22 in the material strip 16 and the material strip 16 begins to combust. The rate at which air is supplied from the preheating chamber 27 to the air and heat exchanging fluid inlet 32 by the second blower 56 is controlled by the computer 62 such that the combustion of the material strip 16 occurs at a desired temperature. In the preferred embodiment, this desired temperature is substantially between 800° C. and 1200° C.

As the material strip 16 is carried through the combustion oven 26 it continues to combust at the desired temperature until the material strip 16 has completely combusted. At this point, the material strip is in the form of a structurally intact, solid residual strip 70 which, in the preferred embodiment, is composed substantially only of dehydrated clay and calcium sulfate. During combustion, a fluegas is produced as shown by arrows A, and, due to factors which are discussed herein below, the fluegas is substantially free of carbon monoxide, nitrogen oxides, sulfur oxides, and micro fly-ash. The fluegas circulates over the heat exchanger 36 and is then removed from the combustion oven 26 by the first and second fluegas outlets 34,35. Fluegas which is removed from the combustion oven 26 through the first fluegas outlet 34 is recirculated into the combustion oven 26 by the first blower 40 through piping 38, piping 42, and the air and heat exchanging fluid inlet 32. The first blower 40 is controlled by the computer 62 such that the rate of recirculation of the fluegas produces a desired rate of heat exchange between the fluegas and the heat exchanger 36.

The residual strip 70 which remains on the conveyor 18 after complete combustion of the material strip 16 is then carried out of the combustion oven 26 through the residual strip outlet 30. The residual strip 70 is carried through the second conduit 46 and into the preheating chamber 27 through the preheating chamber residual strip inlet 48. While the residual strip 70 is carried through the preheating chamber 27, air is cycled over and through the residual strip 70 from the air inlet 52 to the air outlet 54, thereby preheating the air before it is supplied to the combustion oven 26. The residual strip 70 is then carried out of the preheating chamber 27 through the preheating chamber residual strip outlet 50, after which it can be removed for disposal or for further processing. In particular, the residual strip 70 is especially suitable to be reclaimed for the manufacture of cement, building block, and road pavement, since as discussed below it is substantially free of residual carbon.

Figure 2:
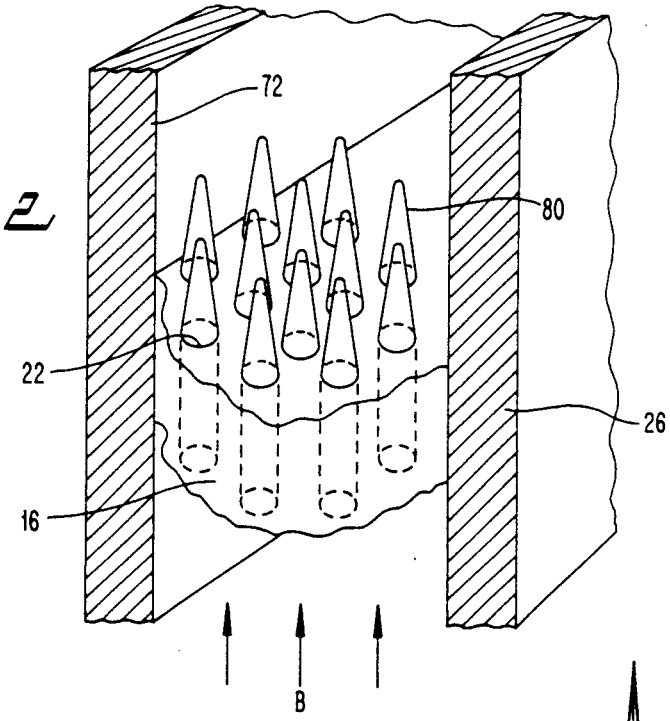
FIG. 2 is a cutaway view of the material strip within the combustion oven.

FIG. 2 shows a cutaway view of the material strip 16 as it is combusted in the combustion oven 26. As seen from FIG. 2, the combustion oven 26 includes inside walls 72 made of, for example, heat insulating brick. The material strip 16 is carried on the conveyor 18 (not shown) through combustion oven 26 such that the walls 72 of the combustion oven 26 closely contact the edges of the material strip 16. This contact prevents air from passing between the walls 72 and the material strip 16. As a result, as air and recirculated fluegas is supplied to the combustion oven 26 as shown by arrows B. The air and fluegas mixture is thereby forced into and through the combusting holes 22.

As mentioned above, the flow of air is regulated by the computer 62 through the second blower 56 such that the combustion temperature of the material strip 16 is between 800° C. and 1200° C. In the preferred embodiment, the combustion temperature is maintained substantially at 1000° C., which is measured by the radiating color of the material strip 16. This combustion temperature is in contrast to atomized fuel combustion processes, which often have combustion temperatures of over 2000° C. Such a high combustion temperature results in the production of large amounts of carbon monoxide, which requires a very large combustion chamber to allow the carbon monoxide to undergo a secondary combustion to carbon dioxide. Because the combustion process of the present invention occurs at a much lower temperature and at a much slower and steady rate, carbon monoxide produced during the combustion undergoes a secondary combustion to carbon dioxide substantially only within the spaced holes 22 and immediately thereabove, thus resulting in blue tongues of fire 80 extending from each of the holes 22. Also, a minimum stoichiometry of 1.0 is all that is needed to maintain ideal combustion in the present invention, as opposed to a minimum stoichiometry of 1.3 to 1.5 required for the conventional processes. As a result, flue heat loss is greatly reduced.

Because the rate of combustion of the material strip 16 is controlled such that combustion occurs more slowly and steady than atomized combustion processes, the combustion process of the present invention is much more complete and produces far less toxic byproducts than the atomized combustion processes. Substantially all of the carbon in the material strip 16 is combusted in the combustion oven 26. Also, substantially all of the sulfur present in the coal of the preferred embodiment is captured in the material strip 16 because of the intimate physical contact between the lime and the coal particles in the material strip 16, and substantially none of the nitrogen present in the air forms nitrogen oxides during the combustion process. As a result, the products of the combustion include a fluegas which is substantially free of carbon monoxide, nitrogen oxides, sulfur oxides, and micro fly-ash, and a structurally intact solid residual strip composed substantially only of dehydrated clay and calcium sulfate. Because the residual strip 70 is substantially free of residual carbon, it is particularly suitable for reclamation for the manufacture of cement, building block, and road pavement. On the other hand, the ash from present power plants is not suitable for these applications because of its high carbon content.

Figure 3:
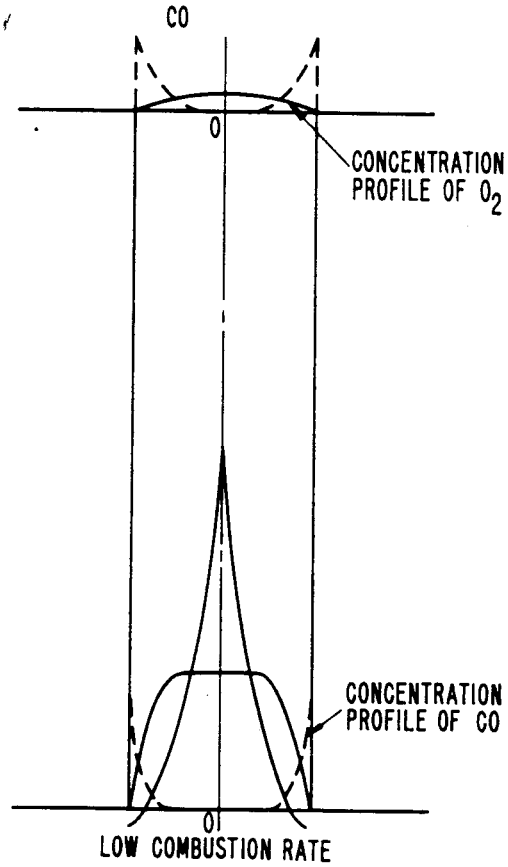
FIG. 3 is a sectional view through one of the plurality of holes in the material strip as the material strip undergoes combustion at a low combustion rate.
Figure 4:
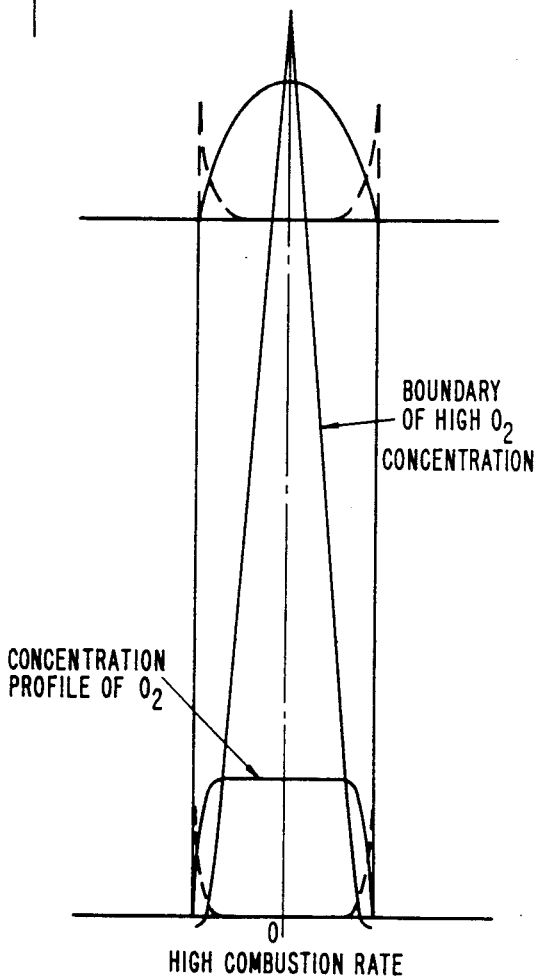
FIG. 4 is a sectional view through one of the plurality of holes in the material strip as the material strip undergoes combustion at a high combustion rate.

FIGS. 3 and 4 give sectional views of one of the plurality of spaced holes 22 as the material strip 16 undergoes combustion at a low rate, and at a high rate, respectively. The combustion process of the present invention is necessarily ablative in nature, and so as the combustion progresses the effective reacting surface available within the hole 22 will increase. This tendency for the combustion rate to increase is counterbalanced, however, because the diffusion path which oxygen from the air entering the hole must travel to reach the reacting surface and which carbon monoxide from the reacting surface must travel to reach the hole 22 increases as the combustion progresses. It provides a stable combustion environment for further regulation of its combustion rate and temperature by a computer.

As will be seen from FIGS. 3 and 4, the diameter to length ratio of the hole 22 is critical to the achievement of proper combustion of the material strip 16. With reference to FIG. 3, when the material strip 16 undergoes combustion at a low combustion rate the gas flow speed in the hole 22 is very slow. Consequently, the CO gas formed in the wall of the hole 22 will have sufficient TIME to diffuse across the center line D of the hole 22 to react with the $O_2$ gas in the hole 22. The $O_2$ gas is therefore nearly exhausted near the exhaust end 74 of the hole 22. Thus, to achieve proper combustion at a low combustion rate, the diameter to length ratio of the hole 22 should be sufficiently large to prevent the complete depletion of $O_2$ in the hole 22 so that at least some oxygen will be present at the exhaust end 74 of the hole 22.

With reference to FIG. 4, under a high combustion rate there will be a much faster gas flow speed in the hole 22, and the boundary layers of the $O_2$ and the CO will be very thin. Consequently there will be a high concentration of $O_2$ at the exhaust end 74 of the hole 22, and most of the secondary combustion of CO to $CO_2$ will take place immediately above the hole 22, which gives rise to a long blue tongue of fire 80. Therefore, for a high combustion rate, more holes with a small diameter to length ratio must be punched in the material strip to insure complete secondary combustion of the CO to $CO_2$.

While this invention has been illustrated and described in connection with the preferred embodiments, it is recognized that variations and changes may be made and equivalents may be employed herein without departing from the scope of the invention as set forth in the claims. For example, instead of carrying away the volatile components of the coal in the material strip 16 for processing after they have been extracted in the preheating oven 24, the volatile components may be separately carried to the combustion oven 26 to be combusted. Also, the heat exchanger 36 need not be immediately within the combustion oven 26, as the fluegas may be carried from the fluegas outlet 34 to a separate heat exchanger before the fluegas is recirculated into the combustion oven 26.

Additionally, the fluegas from the combustion oven 26 need not necessarily be used as the heat exchanging fluid which is supplied to the air and heat exchanging fluid inlet 32, as one skilled in the art would realize that other fluids may be substituted for the fluegas while retaining at least some of the advantages of the present invention. Also, in the preheating chamber 27 the air need not be directly physically passed over and through the residual strip 70 to preheat the air, although this is the most efficient method of heat transfer.

What is claimed is:

1. A method of extracting heat from a combustible material, comprising:

forming a solid material strip of said combustible material;

forming a plurality of spaced holes in said material strip;

combusting said material strip in a combustion oven; and removing a structurally intact solid residual strip from said combustion over after said material strip has been completely combusted.

2. A method of extracting heat from a combustible material as claimed in claim 1, further comprising:

circulating a fluid at a controlled rate to carry heat from the combustion of said material strip to a heat exchanger at a desired rate.

3. A method of extracting heat from a combustible material as claimed in claim 2, wherein said circulating step includes circulating a fluid which includes hot fluegas recycled from said combustion oven.

4. A method of extracting heat from a combustible material as claimed in claim 2, further comprising:

supplying air to said combustion oven at a controlled rate to maintain the temperature of combustion of said material strip at a predetermined temperature.

5. A method of extracting heat from a combustible material as claimed in claim 4, wherein said air supplying step includes maintaining said desired temperature substantially in the range of 800° C. to 1200° C.

6. A method of extracting heat from a combustible material as claimed in claim 4, further comprising:

removing a structurally intact solid residual strip from said combustion oven after said material strip has been completely combusted; and preheating said air by circulating said air past said residual strip prior to supplying said air to said combustion oven.

7. A method of extracting heat from a combustible material as claimed in claim 4, wherein said air supplying step includes supplying said air to said spaced holes in said material strip during combustion so that a secondary combustion of carbon monoxide to carbon dioxide occurs substantially only within said holes and immediately thereabove.

8. A method of extracting heat from a combustible material as claimed in claim 7, wherein said combustion step includes producing a structurally intact solid residual strip, and a fluegas substantially free of carbon monoxide, nitrogen oxides, sulfur oxides, micro fly-ash, and molten iron sulfite.

9. A method of extracting heat from a combustible material as claimed in claim 1, wherein said material strip forming step includes forming said material strip from a mixture including coal, clay, and lime.

10. A method of extracting heat from a combustible material as claimed in claim 9, wherein said combustion step includes the production of a structurally intact solid residual strip composed substantially of dehydrated clay and calcium sulfate, and a fluegas substantially free of carbon monoxide, nitrogen oxides, sulfur oxides, and micro fly-ash.

11. A method of extracting heat from a combustible material as claimed in claim 1, further comprising:

preheating said material strip before combustion, said preheating including circulating a hot fluegas from said combustion oven past said material strip in the absence of ambient air.

12. A method of extracting heat from a combustible material as claimed in claim 1, wherein said material strip forming step includes extruding said material strip.

13. A method of extracting heat from a combustible material as claimed in claim 1, wherein said hole forming step includes punching said spaced holes into said material strip.

14. A method of extracting heat from a combustible material as claimed in claim 1, further comprising:

wherein said combusting step is performed under independent control of heat production rate and temperature.

15. A method of extracting heat from a combustible material, comprising:

forming a solid material strip of said combustible material;

punching a plurality of spaced holes into said material strip;

preheating said material strip in the absence of ambient air;

combusting said material strip in a combustion oven at a desired temperature by supplying air to said plurality of spaced holes at a controlled rate, said combustion step including producing a structurally intact solid residual strip;

circulating a fluid at a controlled rate to carry heat from the combustion of said material strip to a heat exchanger at a desired rate; and removing said solid residual strip from said combustion oven.

16. A method of extracting heat from a combustible material as claimed in claim 15, wherein said material strip forming step includes extruding said material strip.

17. A method of extracting heat from a combustible material as claimed in claim 15, wherein said material strip forming step includes forming said material strip from a mixture of coal, clay, and lime, and said combustion step includes producing a residual strip composed substantially of a mixture of dehydrated clay and calcium sulfate, and a fluegas substantially free of carbon monoxide, nitrogen oxides, and sulfur oxides.

18. A method of extracting heat from a combustible material as claimed in claim 15, wherein said preheating includes circulating a hot fluegas from said combustion oven over a portion of said material strip.

19. A method of extracting heat from a combustible material as claimed in claim 15, wherein said fluid circulating step includes recirculating hot fluegas from said combustion oven back into said combustion oven.

20. A method of extracting heat from a combustible material as claimed in claim 15, wherein said combustion step includes a secondary combustion of carbon monoxide to carbon dioxide which occurs substantially only within said spaced holes and immediately thereabove.

21. A method of extracting heat from a combustible material as claimed in claim 15, further comprising:

preheating said air by circulating said air past said residual strip prior to supplying said air to said plurality of spaced holes.

22. An apparatus for extracting heat from a combustible material, comprising:

means for forming a solid material strip of said combustible material;

means for forming a plurality of spaced holes of variable size and shape in said material strip;

means for combusting said material strip, said means for combusting including a combustion oven; and means for removing a structurally intact, solid residual strip from said combustion oven.

23. An apparatus for extracting heat from a combustible material as claimed in claim 22, further comprising:

a heat exchanger; and means for circulating a fluid at a controlled rate to carry heat from the combustion of said material strip to said heat exchanger at a desired rate.

24. An apparatus for extracting heat from a combustible material as claimed in claim 23, wherein said fluid circulating means includes means for recirculating a hot fluegas from said combustion oven back into said combustion oven.

25. An apparatus for extracting heat from a combustible material as claimed in claim 23, further comprising:

means for supplying air to said combustion oven at a controlled rate to maintain the temperature of combustion of said material strip at a desired temperature.

26. An apparatus for extracting heat from a combustible material as claimed in claim 25, wherein said air supply means maintains said material strip combustion temperature between 800° C. and 1200° C.

27. An apparatus for extracting heat from a combustible material as claimed in claim 25, further comprising:

means for removing a structurally intact, solid residual strip from said combustion oven; and means for preheating said air, said preheating means including means for circulating said air past said residual strip prior to supplying said air to said combustion oven.

28. An apparatus for extracting heat from a combustible material as claimed in claim 25, wherein said air supply means includes means for supplying said air to said spaced holes in said material strip during combustion such that a secondary combustion of carbon monoxide to carbon dioxide occurs substantially only within said holes and immediately thereabove.

29. An apparatus for extracting heat from a combustible material as claimed in claim 22, further comprising:

means for preheating said material strip before combustion thereof, said preheating means including means for circulating a hot fluegas from said combustion oven past said material strip without ambient air.

30. An apparatus for extracting heat from a combustible material as claimed in claim 22, wherein said material strip forming means includes means for extruding said material strip.

31. An apparatus for extracting heat from a combustible material as claimed in claim 22, wherein said hole forming means includes means for punching said holes into said material strip.

32. An apparatus for extracting heat from a combustible material, comprising:

an extrusion screw for extruding a solid material strip of said combustible material;

a conveyor extending away from said extrusion screw for carrying said material strip;

a hole punch located along said conveyor for punching a plurality of spaced holes into said material strip;

a preheating oven located along said conveyor for preheating said material strip; and a combustion oven located along said conveyor for combusting said material strip, said combustion oven including a material strip inlet for inletting said material strip, a residual strip outlet for outletting a structurally intact, solid residual strip, means for intaking air into said combustion oven, and means for removing a hot fluegas from said combustion oven.

33. An apparatus for extracting heat from a combustible material as claimed in claim 32, further comprising:

means for recycling said hot fluegas back into said combustion oven; and a heat exchanger within said combustion oven;

wherein said fluegas recycling means includes means for controlling the circulation rate of said fluegas based on a desired rate of heat exchange between said recycled fluegas and said heat exchanger.

34. An apparatus for extracting heat from a combustible material as claimed in claim 32, further comprising:

mean for controlling the rate of flow of said air into said combustion oven based on a desired temperature of combustion of said material strip.

35. An apparatus for extracting heat from a combustible material as claimed in claim 32, further comprising:

a preheating chamber for preheating said air before said air enters said combustion oven, said preheating chamber including a preheating chamber residual strip inlet for inletting said residual strip, a preheating chamber residual strip outlet for outletting said residual strip, and means for circulating said air past said residual strip.

* * * * *